US006074334A

United States Patent [19]

Mennie et al.

[11] Patent Number: 6,074,334

[45] Date of Patent: Jun. 13, 2000

[54] DOCUMENT FACING METHOD AND APPARATUS

[75] Inventors: Douglas U. Mennie, Barrington; Terry G. Seelenbinder, Elk Grove Village; Charles P. Jenrick, Schaumburg, all of Ill.; Matthew L. Anderson, Salem, Wis.

[73] Assignee: Cummins-Allison Corp., Mount Prospect, Ill.

[21] Appl. No.: 09/181,254

[22] Filed: Oct. 28, 1998

[51] Int. Cl.[7] ..... B31F 1/00; B07C 5/00

[52] U.S. Cl. ..... 493/438; 493/446; 209/534; 271/186

[58] Field of Search ..... 493/438, 446, 493/447, 455, 456, 460, 416, 405, 409, 453, 395; 209/534, 545; 271/186

[56] References Cited

U.S. PATENT DOCUMENTS

| | | | |
|---|---|---|---|
| 3,930,581 | 1/1976 | Gray . | |
| 4,398,088 | 8/1983 | Hirose et al. . | |
| 4,465,192 | 8/1984 | Ohba et al. . | |
| 4,533,824 | 8/1985 | Watanabe . | |
| 4,542,829 | 9/1985 | Emery et al. . | |
| 4,587,408 | 5/1986 | Watanabe . | |
| 4,690,268 | 9/1987 | Ueshin | 209/534 |
| 4,697,071 | 9/1987 | Hiraoka et al. . | |
| 4,721,504 | 1/1988 | Cogswell et al. | 493/438 |
| 4,856,768 | 8/1989 | Hiroki et al. . | |
| 5,112,291 | 5/1992 | VerMehren | 493/438 |

*Primary Examiner*—John Sipos
*Assistant Examiner*—Steven Jensen
*Attorney, Agent, or Firm*—Jenkens & Gilchrist

[57] ABSTRACT

A document facing apparatus for reversing the face orientation of a document includes four substantially similar document folding modules, each having a document gripping and advancing portion and a folding portion. The gripping and advancing portion engages the document along a first longitudinal half portion, with substantially the other longitudinal half portion extending outwardly of the gripping and advancing portion, and advances the entire document through the folding module. The document folding portion engages the document along its other longitudinal half portion and folds the other longitudinal half portion of the document to a substantially 90° angle relative to its initial orientation upon entering the document folding portion. Four document folding modules may be aligned in a given sequence such that a document passing therethrough will have its face orientation reversed.

16 Claims, 7 Drawing Sheets

DOCUMENT FACING METHOD AND APPARATUS

BACKGROUND OF THE INVENTION

The invention is directed generally to the field of document handling apparatus such as bill counting, bill sorting, bill discriminating or authenticating apparatus and the like, and more particularly to a novel document facing method and apparatus for reversing the face orientation of a document such that all of the documents handled by the document or bill handling apparatus will be in the sane, "face-up" or "face-down" orientation.

Many document handling systems such as bill counters, bill discriminator and bill authentication apparatus identify and/or sort currency bills by scanning and identifying characteristics on one or both surfaces or faces of the bills. Some systems automatically reject bills which are fed through the system in oppositely facing orientation. In this regard, documents such as currency bills are generally defined as is having two face orientations, namely a "face-up" or obverse facing orientation or a "face-down" or reverse facing orientation. Thus, each bill or document has an obverse face, for example the face bearing a portrait of a U.S. president in U.S. currency, and a reverse face, for example the surface bearing other pictorial information, such as the word "one" in large letters in U.S. $1 currency, and pictures of various U.S. government buildings in other denominations of U.S. currency.

Often, in bill handling systems which sort the bills by denomination, it is desirable that the sorted bills be in the same face orientation, that is either all "face-up" or all "face-down."

A number of prior art systems and devices have devised various mechanisms for reversing the face orientation of documents such as bills in various bill handling systems. However, as more fully discussed below, most of the systems are either relatively complex and cumbersome, and often relatively slow in operation. In contrast, it is an object of the invention to provide a bill facing apparatus which is relatively simple and reliable in operation and capable of operation at relatively high speed such that it may be used with or incorporated into a relatively high speed bill handling apparatus.

U.S. Pat. No. 3,930,581 relates to a sheet feeding mechanism. The patent describes (e.g., FIG. 5) oppositely rotated drums for reversing the face orientation of bills. However, the documents must be transferred between oppositely rotating drums which are of different diameters. This could cause tearing or jamming of the documents.

U.S. Pat. No. 4,398,088 relates to an automatic bank- note transaction apparatus. As described with reference to FIG. 4 of this patent, a note is turned over by running it through a generally U-shaped path which in effect reverses the orientation of the note, and then returning the note in this turned-over orientation to the beginning of the path. Thus, each turned-over note must be run through at least part of the apparatus twice.

U.S. Pat. No. 4,465,192 relates to an apparatus for processing "paper sheets." The operation is such that reversibly oriented bills are fed to a separate paddle wheel or vane wheel which reverses the orientation of the bills as it deposits them into an associated stacking chamber 34 (FIG. 3). From this separate stacking chamber 34, the bills may at some appropriate time be fed out from the bottom part of the chamber with their now "face-up" orientation and returned to the inlet area of the device to be re-evaluated. Thus, these bills must run through at least part of the apparatus twice.

U.S. Pat. No. 4,542,829 relates to apparatus for sorting "sheets" according to their patterns. The patent discloses only a functional block (see FIG. 1) designated as a "turn-over mechanism 12." No details of this mechanism are disclosed. The patent appears to be directed primarily to the algorithm by which a digital correlator means operates in connection with determining which side of the bill has the better correlation (column 5, lines 45–53).

U.S. Pat. No. 4,587,408 describes an automatic depositing/dispensing apparatus which includes a bill reversal mechanism. The operation with respect to this reversal mechanism is described with reference to FIGS. 6–9. A "judgment section" 30 judges notes to be reversed, and they are directed to a conveyor path 32*c* where they are fed to a paddle wheel 31 which reverses the bills and deposits them in a temporary holding tray 41. This tray 41 may later be moved into a position where pinch rollers (not shown) transfer the notes in their now corrected orientation back to the inlet to be run again through the judgment section 30. This involves the rather time-consuming feature of first separating out reverse oriented bills, flipping them over and then reintroducing them back to the beginning of the conveyor path of the machine.

U.S. Pat. No. 4,690,268 relates to a sheet convey apparatus including a twisted convey path which turns the sheets 180°. The structure of this twisted convey path is illustrated in FIGS. 3–7 of the drawings, and includes a belt which is twisted 720° and looped in a figure-8 configuration.

U.S. Pat. No. 4,697,071 concerns a "circulation-type" automatic money receiving and paying machine with note side identifying and note turning-over sections. Here, the note turning-over section (see FIG. 1) is located downstream of the identifying section. The turning over mechanism is shown in FIG. 3, and its operation is described with reference to FIGS. 4*a–f* and 5*a–e*. This is an involved mechanism incorporating a number of belts, rollers, vanes and a pivoting "direction changing board."

U.S. Pat. No. 4,856,768 relates to a separating device for a "sheet collecting apparatus." The device presents separate paths for obverse and reverse oriented bills; however, it would appear that the bills are not flipped a such, but merely that only bills with the same orientation are stacked into the container at a given time. That is, if obverse oriented bills are being stacked in the container, the reverse oriented bills are held until the container is emptied, and then only reverse oriented bills are stacked in the container. Although the description states, at column 4, lines 37–38 "the sides of the bank notes are aligned in the same manner when the bank notes are collected in the collecting chamber 168," it does not appear that a flipping of the bills to achieve this would in fact take place with the mechanism as illustrated and described.

SUMMARY OF THE INVENTION

Accordingly, it is a general object of the invention to provide a novel and improved bill facing method and apparatus.

A related object is to provide a bill facing method and apparatus which can be operated at relatively high speeds.

A further related object is to provide a bill facing apparatus in accordance with the foregoing objects which can be incorporated into the bill transport path of a bill handling machine.

Briefly, and in accordance with the foregoing objects, a document facing apparatus for reversing the face orientation of a document comprises four substantially similar document folding modules, each of the folding modules comprising a document gripping and advancing portion for engaging the document along a first longitudinal half portion of the document, with substantially the other longitudinal half portion of the document extending outwardly of the gripping and advancing portion, and for advancing the entire document through the folding module; and a document folding portion for engaging the document along the other longitudinal half portion of the document and folding the other longitudinal half portion of the document to a substantially 90° angle relative to its orientation upon entering said document folding portion, the four document folding modules being aligned in a sequence such that a document passing therethrough will have its face orientation reversed.

In accordance with another aspect of the invention, a document folding module for use in an apparatus for changing the orientation of a document comprises a document gripping and advancing portion for engaging the document in a first longitudinal half portion of the document, with substantially the other longitudinal half portion of the document extending outwardly of the gripping and advancing portion, and for advancing the entire document through the folding module; and a document folding portion for engaging the document along the other longitudinal half portion of the document and folding the other longitudinal half portion of the document to a substantially 90° angle relative to its orientation upon entering said document folding portion.

In accordance with another aspect of the invention, a method for reversing the face orientation of a document comprises four gripping the document in a first longitudinal half portion of the document, with substantially the other longitudinal half portion of the document extending freely outwardly; advancing the entire document in a first direction; folding the other longitudinal half portion of the document to a substantially 90° relative to angle its initial orientation substantially simultaneously with said gripping and advancing; and repeating said gripping advancing and folding steps in a predetermined sequence such that a document will have its face orientation reversed, after four iterations of said gripping, advancing and folding steps.

DETAILED DESCRIPTION OF THE ILLUSTRATED EMBODIMENT

While the apparatus of the invention may be utilized with respect to documents of other types, the description will be facilitated by reference to the specific problem of reversing the face orientation of a currency bill. In this regard, the drawings illustrate a U.S. $1 bill as a specific example.

Figure 1:
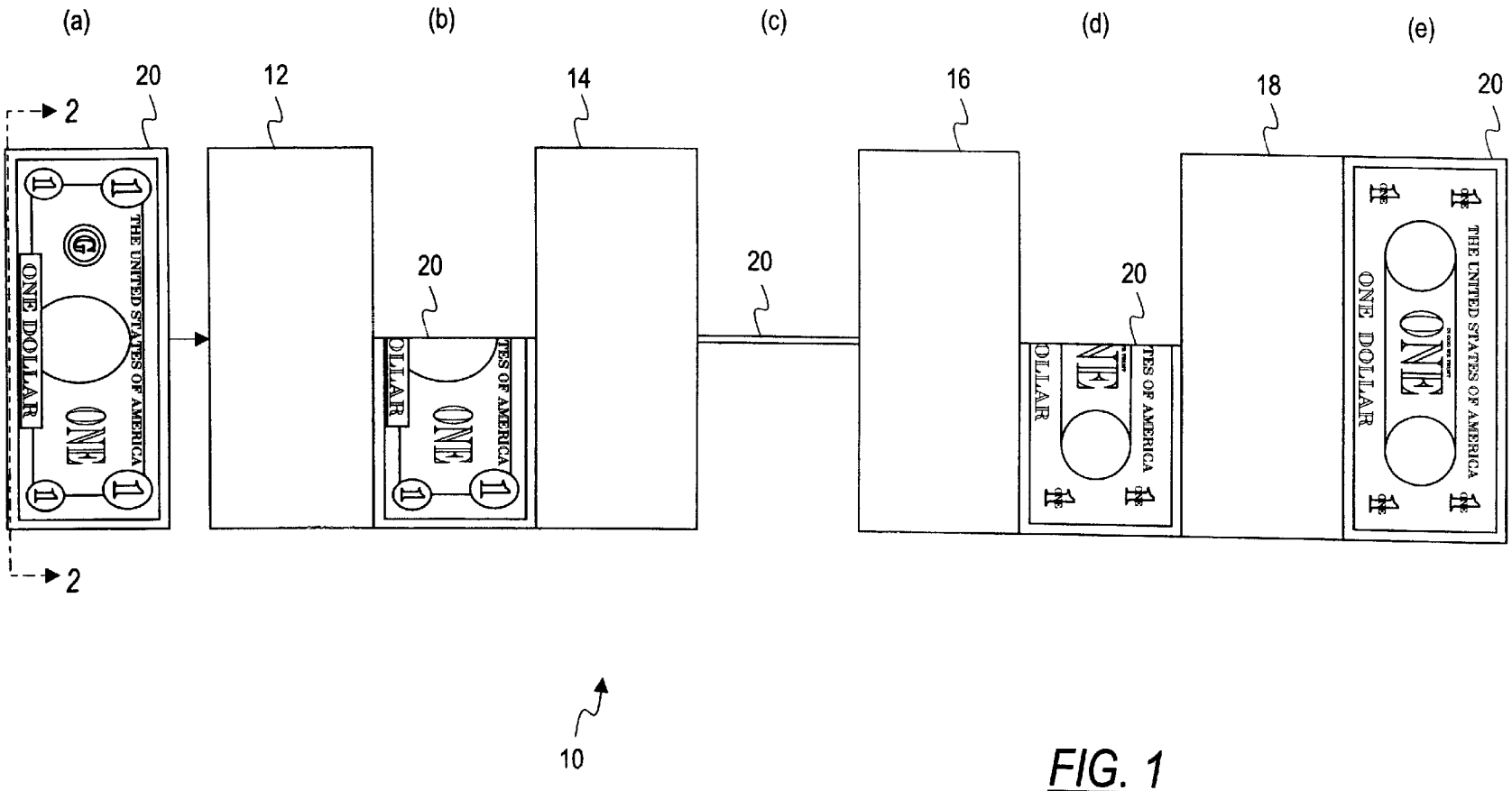
FIG. 1 is a simplified diagram illustrating operation of the bill facing apparatus of the invention.
Figure 2:
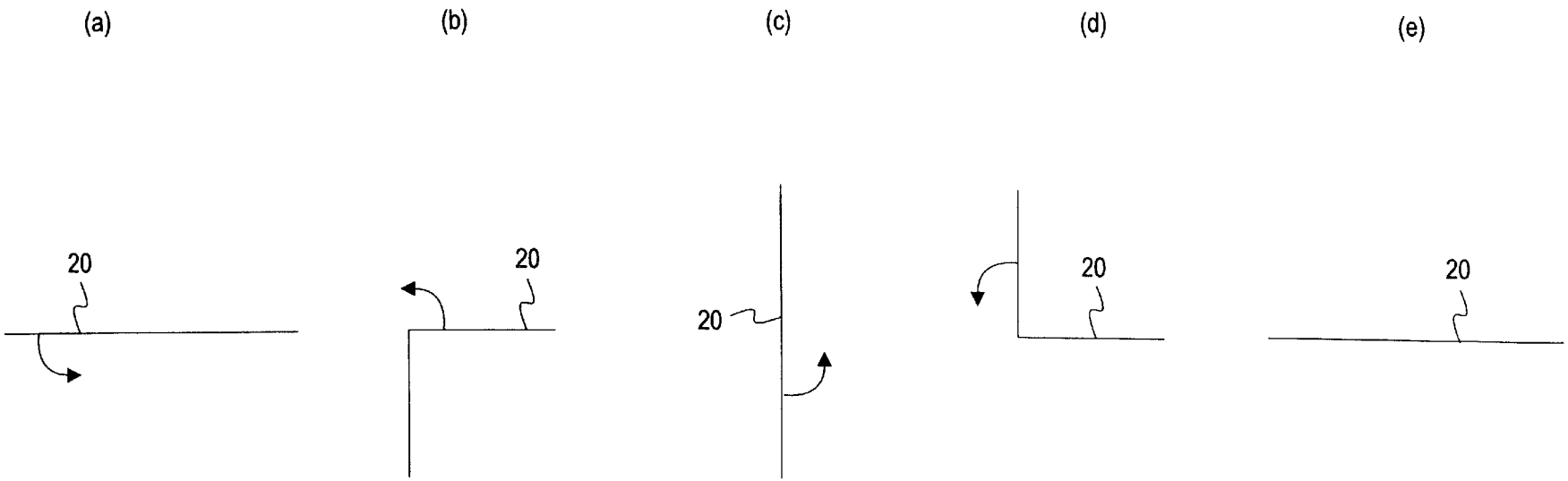
FIG. 2 is a series of simplified diagrams showing the stages of operation of the apparatus of the invention for reversing the face orientation of a bill, taken on edge of a bill as it is transported through the apparatus of the invention, as indicated generally by the lines 2—2 of FIG. 1.

Referring now to the drawings, and initially to FIGS. 1 and 2, a document facing apparatus in accordance with the invention is designated generally by the reference numeral 10. In accordance with another aspect of the invention, four substantially similar modules 12, 14, 16 and 18 make up the document facing apparatus. Each of these modules 12, 14, 16 and 18, which may be referred to as "folding modules," is adapted to fold one half of a document at an angle of 90° relative to its orientation upon entering the module while advancing the document therethrough. Thus, by aligning a respective modules end to end as viewed in FIG. 1 and appropriately configuring or locating respective components of each module, as more fully described below, the entire document 20, which may be a currency bill, can be rotated by 180°, that is, have its face orientation reversed. It will be appreciated that the bill 20 can be rotated by 90° by the use of two such modules, for example, the modules 12 and 14 if desired. While the invention is illustrated and described herein with reference to the problem of reversing the face orientation of a bill, that is, rotating it by 180°, the principles of the invention may be utilized for rotating a bill through some other number of degrees without departing from the invention. Thus, the individual modules 12, 14, 16 and 18 could also be designed to rotate or fold a bill 20 such that one half of the bill forms some angle less than 90°, with subsequent modules being designed to fold alternating halves of the bill through the same angle to return the bill to a flat condition, whereby two such modules may rotate the bill by less than 90° and four such modules would rotate the bill by some angle between 90° and 180°.

However, in the illustrated embodiment, four substantially similar such modules are utilized, each folding one half of the bill 20 over to a 90° angle with respect to its orientation prior to entering the module. The four modules are aligned with each other so as to fold alternating halves of the bill by 90° a total of four times in the same sense, that is, either clockwise or counterclockwise, to achieve a reversal of the face orientation of the bill as indicated at stations (a) through (e) of FIG. 1.

FIG. 2 indicates generally an edge view of the bill 20 as taken for example at the line 2—2 of FIG. I as it is advanced through each of the positions (a) through (e) of FIG. 1. In the embodiment illustrated in FIG. 2, the successive directions of folding of the bill are indicated by arrows, and are in the counterclockwise direction. However, it should be recognized that the modules may be oriented to so fold the bill 20 in successive clockwise intervals when viewed from the same location, without departing from the invention.

As shown diagrammatically in FIGS. 1 and 2, at a first position (a) a document such as a U.S. $1 bill enters the facing apparatus 10 in a "face-up," flat orientation. At a first station or module 12, the first half of the bill is bent down by a 90° angle relative to its flat or horizontal orientation when entering, as shown at position (b). It will be understood that while the diagrammatic illustration of FIG. 1 shows a space between the various modules 12, 14, 16 and 18, in practice, the bill is fed directly from one module to the next immediately adjacent module with virtually no such space therebetween. The additional space in FIG. 1 has been added to permit illustration of the orientation of the bill as it enters each subsequent module. Thus, as shown in FIG. 2, at position (b) one half of the bill is now bent at a 90° angle relative to the other half. It should be noted that in the case of documents such as currency bills, the halves referred to herein comprise longitudinal halves of the bill. Similarly, with any document having one dimension greater than another dimension, the fold will be transversely through the longer dimension of the document.

At the second module 14, the half of the bill which was folded by the module 12 is gripped and held in its now vertical orientation (as viewed in FIG. 2) while the other half of the bill is folded in a clockwise direction as viewed in FIG. 2 through substantially 90°, such that the entire bill is now flat in a vertical position, as shown at position (c).

At the next module 16, the bottom half of the bill is folded in a clockwise direction 90° to result in the orientation shown at position (d) in FIGS. 1 and 2. Finally, at the last module 18, the top vertical half of the bill as viewed in FIG. 2 is folded 90° to result in the bill returning to a flat and substantially horizontal position as shown at position (e), where it exits the apparatus 10.

It will be noted with reference to FIGS. 1 and 2 that this serious of counterclockwise folds has resulted in a reversal of the face orientation of the bill between its entering orientation at position (a) and its exiting orientation at position (e), such that at position (e) the reverse face of the bill is now visible. In the example illustrated, with a U.S. $1 bill, this reverse face bears the enlarged letters ONE.

It will be noted that if some angle other than 90° is chosen for the modules 12, 14, 16 and 18, the exiting orientation of the bill will be at some angle other than 180° relative to its entering orientation. For example, if each module folds one half of the bill through an angle of 60° relative to its entering orientation, the exiting bill will be rotated through a total of 120° of its entering orientation. Similarly, if each module folded one half of the bill by 110° then the exiting bill would be rotated by a total of 220° relative to its entering orientation. Moreover, lesser angles of rotation of the bill could be achieved by the use of only two such modules. For example, it will be noted that the bill exits the second module 14 at position (c) rotated by 90° relative to its entering orientation. If smaller angles are employed in each of the modules 12 and 14, the exiting bill could be effectively rotated by some lesser amount, from 0 to 90°, relative to its entering orientation, using only the two modules 12 and 14. However, it is the goal in the illustrated embodiment to reverse the face orientation of the bill, that is, to rotate the bill through 180°.

Figure 3:
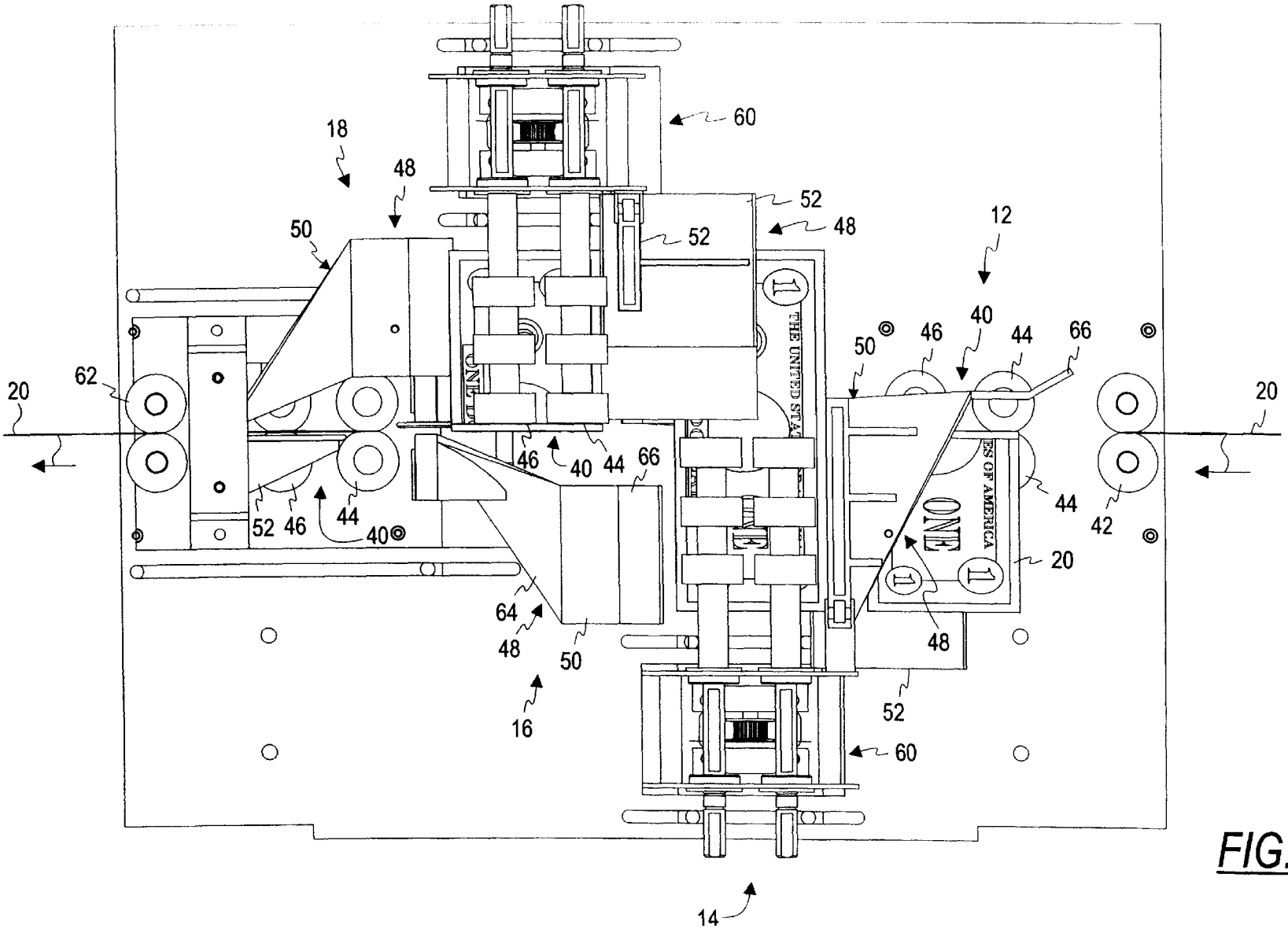
FIG. 3 is a side elevation of the apparatus of the invention.
Figure 4:
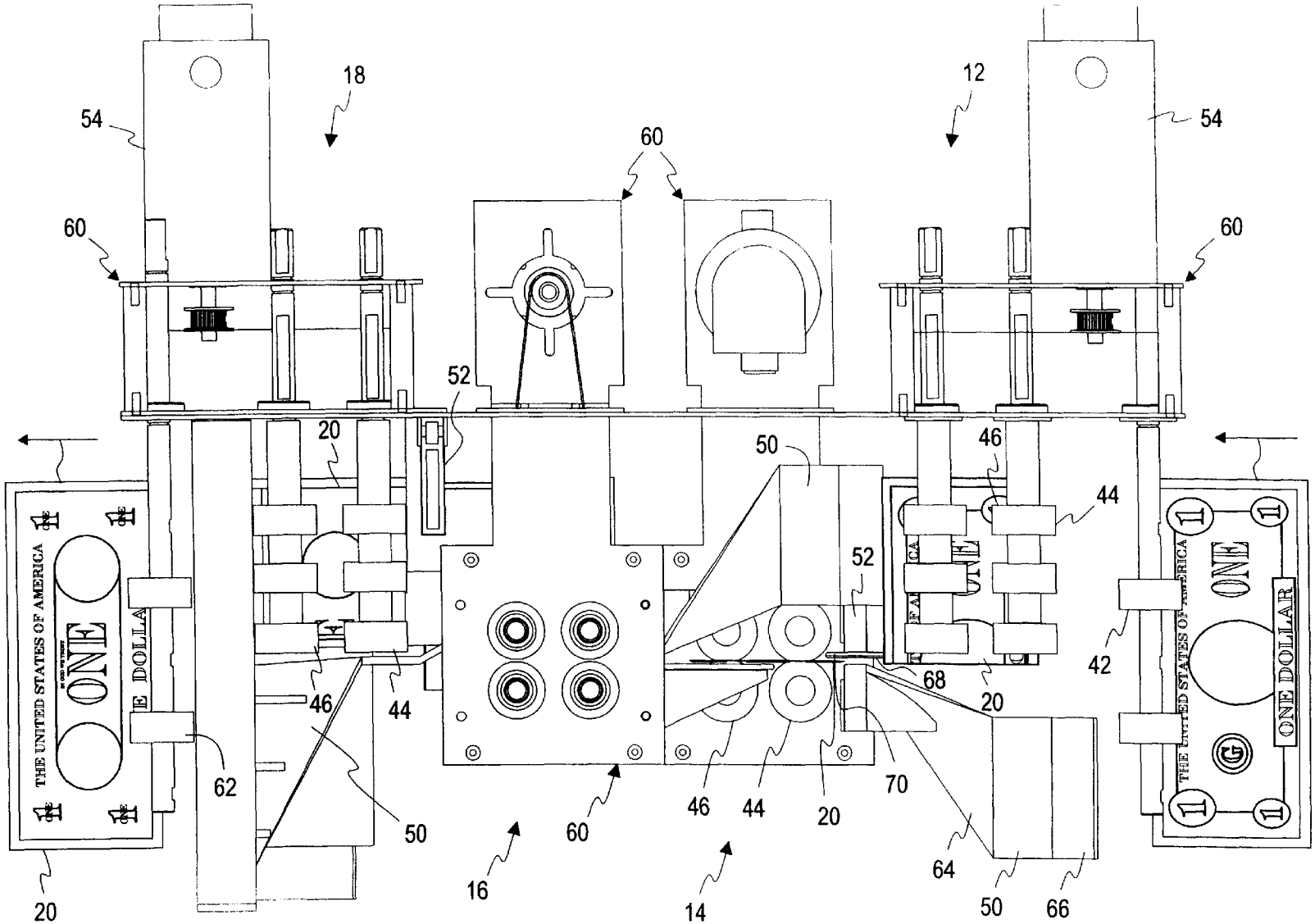
FIG. 4 is a top plan view of the apparatus of the invention.
Figure 5:
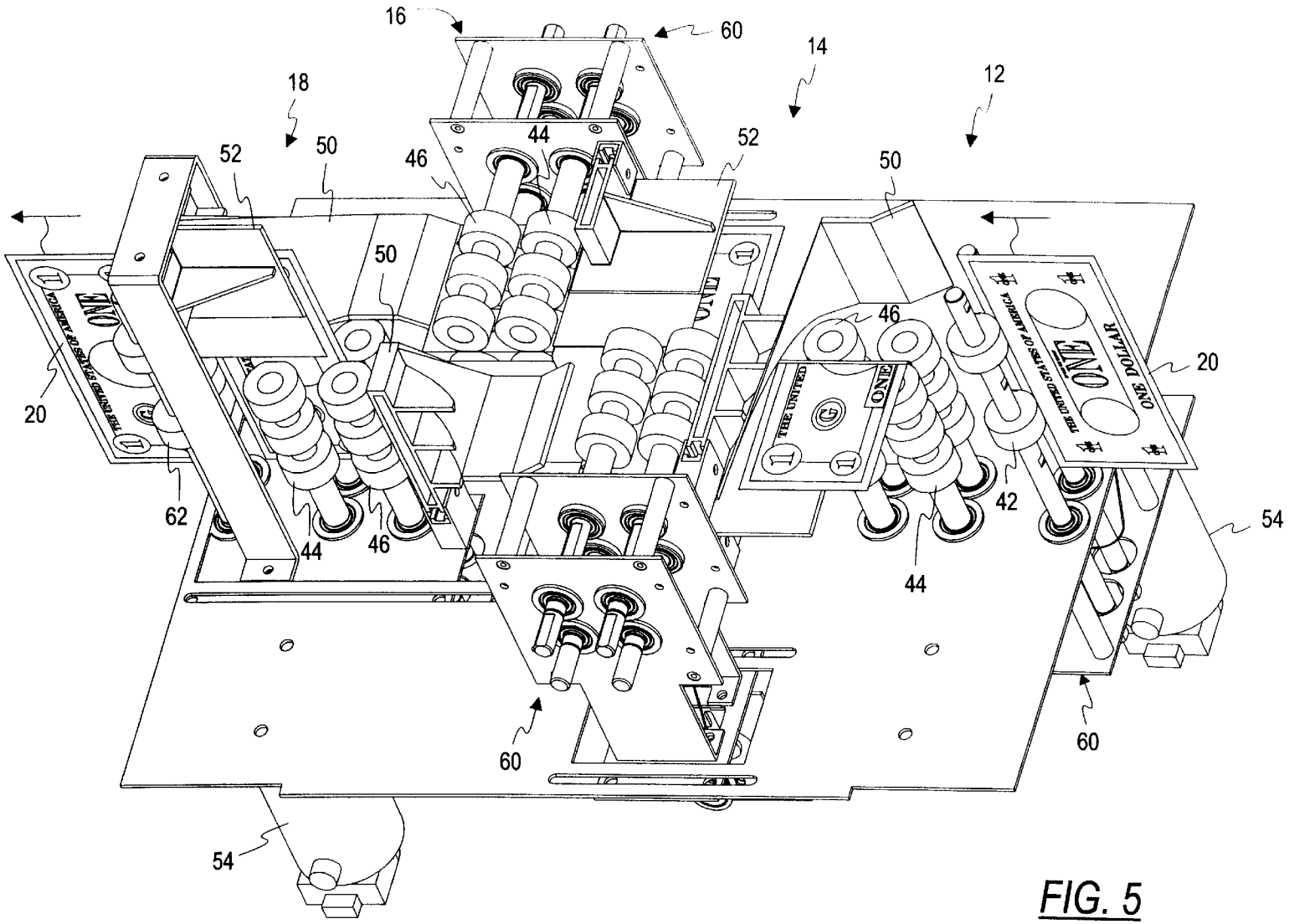
FIG. 5 is a perspective view of the apparatus of the invention.
Figure 9:
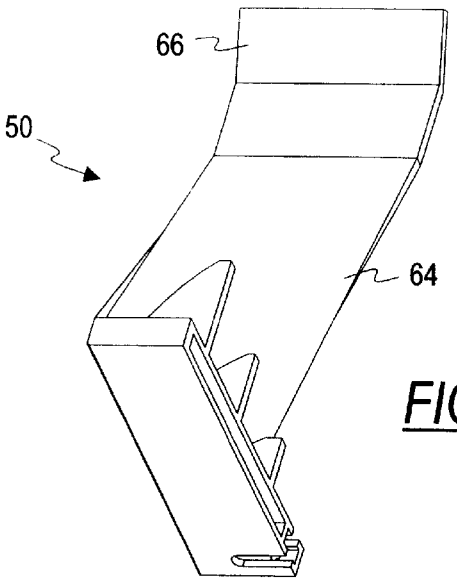
FIGS. 6–8 are respective elevations and FIG. 9 is a perspective view of a curved guide plate portion of the apparatus of the invention.
Figure 8:
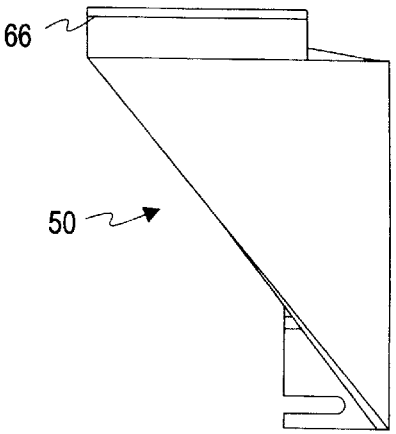
Figure 6:
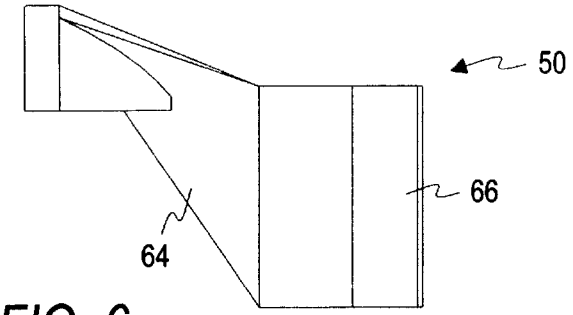
Figure 7:
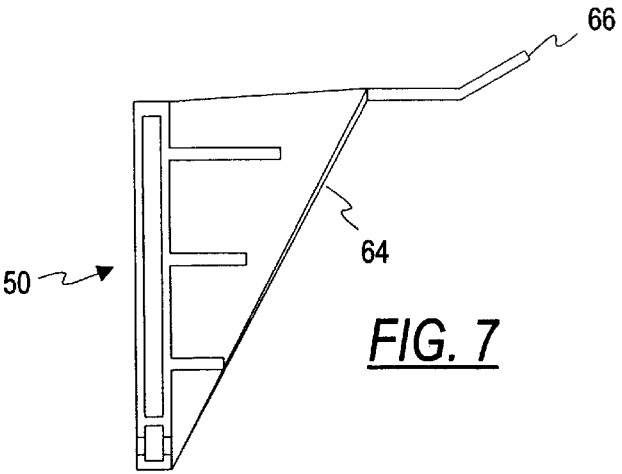
Figure 13:
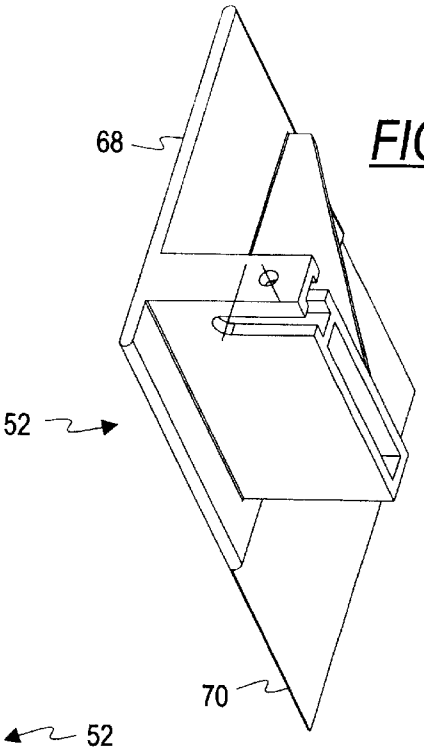
FIGS. 10–12 are elevations and FIG. 13 is a perspective view of a secondary guide member of the apparatus of the invention.
Figure 12:
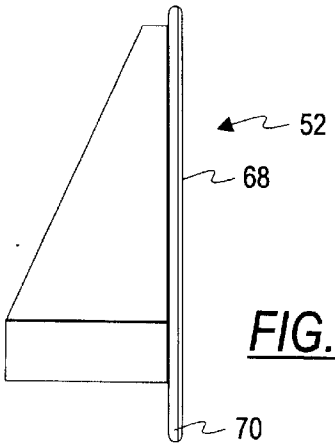
Figure 10:
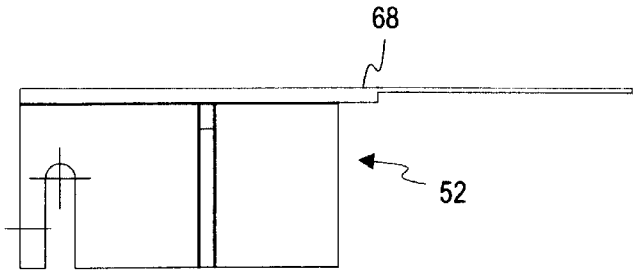
Figure 11:
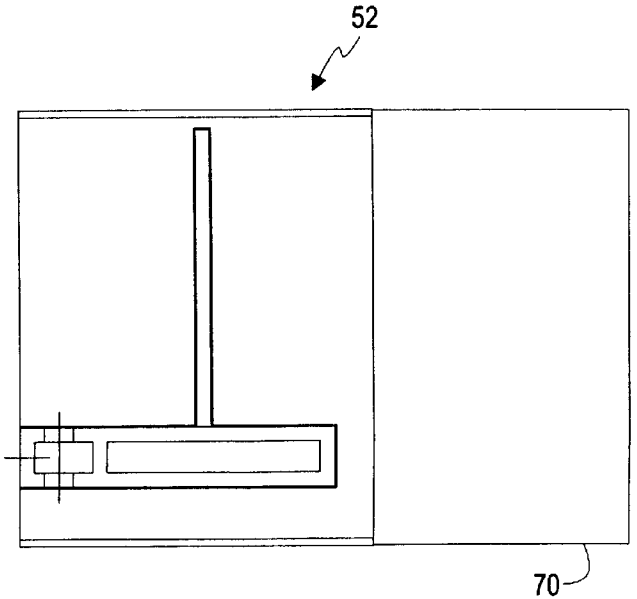

FIGS. 3–5 illustrate the substantially similar modules 12, 14, 16 and 18 in side elevation and respectively configured and aligned to form the four-module bill facing apparatus of FIG. 1 for reversing the face orientation of a bill. Since the various components of the four modules 12, 14, 16 and 18 are substantially identical, only one such module will be fully described with like reference numerals being utilized the like parts and components of the other modules.

Referring now to FIGS. 3–5, the module 12 has a bill gripping and advancing portion 40 which includes a plurality of pairs of opposed rollers 44 and 46 which grippingly engage and rotate so as to advance the bill 20 through the module in the direction indicated by the arrows. This is so as to receive a bill from inlet rollers 42 of the apparatus and to feed it through to the next bill folding module 14. A second portion 48 of the module 12 comprises a bill folding portion which utilizes a curved guide member or plate 50 and a secondary guide member or plate 52 opposingly facing the first guide member 50 so as to guide substantially one half of the bill into a 90° folded configuration with respect to its orientation when entering the module 12, while the first longitudinal half portion of the bill is held between the pairs of rollers 44 and 46 which advance it into and along the curved guide plate 50. In the illustrative embodiment, one roller of each of the pairs of rollers 44 and 46 is driven by a motor 54 and a drive train 60. The respective curved guide plate 50 and secondary guide plate 52 are shown in further detail in FIGS. 6–9 and FIGS. 10–13 respectively.

The main or curved guide plate member 50 has a curved surface 64 and a bentover leading lip 66 which are configured and arranged for encountering and bending over one longitudinal half of a bill as the bill encounters the edge 66 and surface 64.

The secondary guide plate or member 52 has a flat surface 68 which generally guides one half of the bill into the entrance of the rollers of the next module, as well as into the outlet rollers 62 at the end of the apparatus 10. The flat guide plate 52 also has an edge surface 70 which serves to control the bend radius of the bent or folded over bill as it is transferred between first module 12 and second module 14 and between the third module 16 and the fourth module 18, to maintain the bend radius as the folded bill is fed into the next set of rollers in each instance.

The relative orientation of the respective guide plates 50, 52 and the gripping and advancing rollers 44, 46 are selected in each of the modules 12, 14, 16 and 18 to achieve the desired folding operation as illustrated in FIGS. 1 and 2 in that particular module. Thus, in the modules 12 and 16, for example, the bill emerges with its two halves folded at a 90° angle, whereas in the modules 14 and 18 the bill emerges in a flat or unfolded condition.

In the illustrative embodiment, the respective pairs of rollers 46 and 48 are is mounted on generally parallel shafts, which extend into respective drive trains 60 so as to be driven via the drive trains 60, by respective motors 54 to achieve a constant speed. Preferably, relatively accurate servo-motors are utilized so that the speed is maintained constant throughout the four modules 12, 14, 16 and 18. The illustrated embodiment uses two such motors 54, with appropriate drive trains for driving all four modules. However, one servo-motor may be used for each module 12, 14, 16, 18, or, one servo-motor for the "outer" modules 12, 18 and one for the "inner" modules 14, 16, or one motor for all modules, with suitable belt and pulley interconnections, without departing from the invention. In one embodiment of the invention illustrated, speeds of 1,000 bills per minute or greater are possible.

Advantageously, it will be seen that the bill facing apparatus of the invention may readily be placed "in line" in the transport path of a bill handling machine for reversing or otherwise modifying the face orientation of a bill at any desired point in the bill handling process. The relative accuracy of the apparatus of the invention in reversing the face orientation of the bills, coupled with its relatively high speed of operation as noted above, make it particularly useful for reversing bill orientations in connection with high speed bill handling apparatus such as sorters, denominators and authenticating apparatus. Also, it will be seen that the bill 20 enters and leaves the apparatus 10 of the illustrated embodiment of the invention in substantially the same plane and substantially centered along the same or a common axis through the apparatus 10.

While particular embodiments and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. A document facing apparatus for reversing the face-up/face-down orientation of a generally rectilinear document having an obverse face and a reverse face, a longitudinal dimension, opposed longitudinal edges and opposed lateral edges, said apparatus comprising four substantially similar document folding modules, each of said folding modules comprising a document gripping and advancing portion for engaging the document along a first longitudinal half portion of the longitudinal dimension of the document, with substantially the other longitudinal half portion of the longitudinal dimension of the document extending outwardly of the gripping and advancing portion, and for advancing the entire document through the folding module; and a document folding portion for engaging the document along said other longitudinal half portion of the longitudinal dimension of the document and folding said other longitudinal half portion of the longitudinal dimension of the document to a substantially 90° angle relative to its orientation upon entering said document folding portion, said four document folding modules being aligned in a sequence such that a document passing therethrough will have its face-up/face-down orientation reversed.

2. The apparatus of claim 1 wherein said document folding modules are respectively aligned with each other, such that the document gripping and advancing portion of each subsequent module is aligned with the document folding portion of the preceding module for receiving the half of the document which was folded by the document folding portion of the preceding module, such that the respective halves of the document constituting the folded half of the document and the engaged half of the document alternate as the document passes through each subsequent document folding module.

3. The apparatus of claim 1 wherein said document folding modules are respectively aligned with each other, such that the document folding portion of each module folds one half of the document in the same one of a clockwise and counterclockwise directions, said clockwise and counterclockwise directions being defined as viewed from one of the longitudinal edges of the document.

4. The apparatus of claim 1 wherein said document gripping and advancing portion comprises a plurality of rollers arranged in opposing pairs for engaging a document therebetween.

5. The apparatus of claim 1 wherein said folding portion comprises a curved guide plate.

6. The apparatus of claim 5 wherein said folding portion comprises a secondary guide plate aligned with said first guide plate in a predetermined fashion.

7. A document facing method for reversing the face-up/face-down orientation of a generally rectilinear document having an obverse face and a reverse face, a longitudinal dimension, opposed longitudinal edges and opposed lateral edges, said method comprising gripping and advancing the document along a first longitudinal half portion of the longitudinal dimension of the document, with substantially the other longitudinal half portion of the longitudinal dimension of the document extending freely outwardly and folding said freely outwardly extending longitudinal half portion of the longitudinal dimension of the document to a substantially 90° angle relative to its orientation upon entering said document folding portion substantially simultaneously with said gripping and advancing; repeating said gripping, advancing and folding steps in a predetermined sequence such that a document will have its face-up/face-down orientation reversed after four iterations of said gripping, advancing and folding steps.

8. The method of claim 7 wherein said predetermined sequence is such that the gripping and advancing steps of each subsequent iteration are performed upon the half of the document which was folded by folding step of the preceding iteration, such that the respective halves of the document constituting the folded half and the engaged half of the document alternate in each subsequent iteration.

9. The method of claim 7 wherein said predetermined sequence is such that the folding step of each iteration folds one half of the document in the same one of a clockwise and counterclockwise direction, said clockwise and counterclockwise directions being defined as viewed from one of the longitudinal edges of the document.

10. A document handling apparatus for changing the face-up/face-down orientation of a generally rectilinear document having an obverse face and a reverce face, a longitudinal dimension, opposed longitudinal edges and opposed lateral edges, said apparatus comprising at least two substantially similar document folding modules, each of said folding modules comprising a document gripping and advancing portion for engaging the document in a first longitudinal half portion extending from one edge to the center of the longitudinal dimension of the document, with substantially the other longitudinal half portion extending from the center to the other edge of the longitudinal dimension of the document extending outwardly of the gripping and advancing portion, and for advancing the entire document through the folding module; and a document folding portion for engaging the document along said other longitudinal half portion of the longitudinal dimension of the document and folding said other longitudinal half portion of the longitudinal dimension of the document to a selected angle relative to its orientation upon entering the module, said at least two document folding modules being aligned in a sequence such that a document passing therethrough will have its face-up/face-down orientation rotated by said selected angle or a multiple thereof; and wherein said document folding modules are respectively aligned with each other, such that the document gripping and advancing portion of each subsequent module is aligned with the document folding portion of the preceding module for receiving the half of the document which was folded by the document folding portion of the preceding module, such that the respective halves of the document constituting the folded half and the engaged half of the document alternate as the document passes through each subsequent document folding module.

11. The apparatus of claim 10 wherein said document folding modules are respectively aligned with each other, such that the document folding portion of each subsequent module folds one half of the document in the same one of a clockwise and counterclockwise direction, said clockwise and counterclockwise directions being defined as viewed from one of the longitudinal edges of the document, as the document folding portion of each other document folding module.

12. The apparatus of claim 10 wherein said document gripping and advancing portion comprises a plurality of rollers arranged in opposing pairs for engaging a document therebetween.

13. The apparatus of claim 10 wherein said folding portion comprises a curved guide plate.

14. The apparatus of claim 13 wherein said folding portion comprises a secondary guide plate aligned with said first guide plate in a predetermined fashion.

15. A document facing method for rotating the face-up/face-down orientation of a generally rectilinear document having an obverse face and a reverse face, a longitudinal dimension, opposed longitudinal edges and opposed lateral edges, said method comprising gripping and advancing the document along a first longitudinal half portion extending from one edge to the center of the longitudinal dimension of the document, with substantially the other longitudinal half portion extending from the center to the other edge of the longitudinal dimension of the document extending freely outwardly and folding said freely outwardly extending longitudinal half portion of the longitudinal dimension of the document to a selected angle relative to its orientation upon entering said document folding portion substantially simultaneously with said gripping and advancing; repeating said gripping, advancing and folding steps in a predetermined sequence such that a document will have its face-up/face-down orientation rotated by a selected amount after at least two iterations of said gripping, advancing and folding steps; and wherein said predetermined sequence is such that the gripping and advancing steps of each subsequent iteration are performed upon the half of the document which was folded by folding step of the preceding iteration, such that the respective halves of the document constituting the folded half and the engaged half of the document alternate in each subsequent iteration.

16. The method of claim 5 wherein said predetermined sequence is such that the folding step of each iteration folds one half of the document in the same one of a clockwise and counterclockwise direction, said clockwise and counterclockwise direction being defined as viewed from one of the longitudinal edges of the document.

* * * * *